US006132188A

United States Patent [19]

Brunee

[11] Patent Number: 6,132,188

[45] Date of Patent: Oct. 17, 2000

[54] DOSING PUMP WITH MAGNETIC CONTROL

[75] Inventor: Jacky Brunee, Aveze, France

[73] Assignee: Serac Group, La Ferte Bernard, France

[21] Appl. No.: 09/202,502

[22] PCT Filed: Jul. 7, 1997

[86] PCT No.: PCT/FR97/01220

§ 371 Date: Dec. 16, 1998

§ 102(e) Date: Dec. 16, 1998

[87] PCT Pub. No.: WO98/02658

PCT Pub. Date: Jan. 22, 1998

[30] Foreign Application Priority Data

Jul. 15, 1996 [FR] France ..... 96 08816

[51] Int. Cl.[7] ..... F04B 49/00; F04B 7/00

[52] U.S. Cl. ..... 417/505; 417/514

[58] Field of Search ..... 417/505, 514, 417/555.1, 555.2, 511

[56] References Cited

U.S. PATENT DOCUMENTS

| | | | |
|---|---|---|---|
| 2,686,280 | 8/1954 | Strong et al. | 318/125 |
| 3,532,446 | 10/1970 | Herreshoff | 417/511 |
| 3,899,703 | 8/1975 | Kinnison | 310/103 |
| 4,080,112 | 3/1978 | Zimmermann | 417/420 |
| 4,231,722 | 11/1980 | Teichmann | 417/418 |
| 4,465,439 | 8/1984 | Seino | 417/417 |

FOREIGN PATENT DOCUMENTS

| | | |
|---|---|---|
| 0025562 | 3/1981 | European Pat. Off. . |
| 3515757 | 11/1986 | Germany . |

*Primary Examiner*—Henry C. Yuen
*Assistant Examiner*—Mahmoud M Gimie
*Attorney, Agent, or Firm*—Birch, Stewart, Kolasch & Birch, LLP

[57] ABSTRACT

The invention relates to a metering pump comprising a pump chamber (2) having a longitudinal axis (3) and presenting an admission orifice (4) and a delivery orifice (5), a piston (6; 30) pierced by a pump orifice (7), a drive rod (8) for driving the piston (6; 30), a non-return valve (17) mounted to move relative to the piston (6; 30), and a sleeve (9) of non-magnetic material mounted stationary inside the pump body (1) parallel to the longitudinal axis (3) of the pump chamber (2) and possessing a closed end (10) situated inside the pump body (1), and an open end (11) opening out to the outside of the pump body (1), the drive rod (8) being fitted with a magnetic element (12) co-operating, through the sleeve, with a magnetic cage (13) surrounding the sleeve (9) and coupled to the piston (6; 30).

7 Claims, 2 Drawing Sheets

DOSING PUMP WITH MAGNETIC CONTROL

The present invention relates to a metering pump designed in particular for fitting to a machine for measuring out liquids.

BACKGROUND OF THE INVENTION

Metering pumps are known that comprise a pump body defining a cylindrical pump chamber having an admission orifice and a delivery orifice situated at opposite ends of the chamber. A piston associated with a drive rod is mounted inside the pump chamber to slide with reciprocating motion between the admission orifice and the delivery orifice. The piston has a pump orifice passing therethrough, which orifice is alternately opened and closed by a non-return valve.

With pumps of that kind, the fluid to be packaged comes into contact with both faces of the piston, thereby solving some of the liquid contamination problems that arise with conventional positive displacement pumps in which the liquid to be metered out comes into contact with one side only of the piston (the admission and delivery orifices of the pump chamber then both being situated at the same end of the chamber).

However, in existing pumps, the drive rod passes through the wall of the pump body, thus making it necessary to provide sealing between said wall and the drive rod. This sealing gives rise to difficult problems, particularly when the fluid to be packaged is abrasive or chemically aggressive, since the reciprocating motion of the drive rod runs the risk of damaging the gaskets quickly. Major problems also arise when fluids need to be packaged in sterile manner because of the pollution that might be conveyed by the drive rod in its reciprocating motion: it is then necessary to provide complex devices making use of sterile fluid or vapor barriers, or indeed membranes which are fragile.

OBJECTS AND SUMMARY OF THE INVENTION

The invention provides a metering pump comprising a pump body defining a cylindrical pump chamber having a longitudinal axis and presenting an admission orifice and a delivery orifice situated at opposite ends thereof, a piston having a pump orifice passing therethrough and mounted inside the pump chamber to slide in reciprocating motion between the admission orifice and the delivery orifice, a drive rod for driving the piston, a valve mounted to move relative to the piston between a position in which it opens the pump orifice and a position in which it closes it, and a sleeve of non-magnetic material mounted stationary inside the pump body parallel to the longitudinal axis of the pump chamber and possessing a closed end situated inside the pump body and an open end opening to the outside of the pump body, the drive rod being fitted with a magnetic element acting through the sleeve to co-operate with a magnetic cage surrounding the sleeve and coupled to the piston.

In this way, the drive rod which moves inside the sleeve is completely isolated by the sleeve from the flow inside the pump chamber. Sealing is provided only between the sleeve and the pump body which are fixed relative to each other. There is thus no risk of leakage or contamination of the above-mentioned fluid.

According to other advantageous characteristics of the invention:

the drive rod is fitted with a second magnetic element co-operating through the sleeve with a second magnetic cage surrounding the sleeve and secured to the valve;

the valve and the second magnetic cage are mounted to slide on the sleeve and the second magnetic element is disposed to urge the valve constantly towards its closed position. The field generated between the second magnetic element and the second magnetic ring thus provides magnetic return for the valve. Unlike the resilient return force exerted by a spring, the magnetic force field decreases on opening and increases on closing, thereby improving the operation of the non-return valve.

In a variant embodiment, the valve and the second magnetic cage are mounted to pivot relative to the sleeve.

In an advantageous embodiment, the magnetic cage comprises at least two rings surrounding the sleeve and interconnected by a link member extending parallel to the sleeve, the magnetic element generating a magnetic field parallel to the axial direction of the sleeve and possessing two ends having the rings of the magnetic cage placed in register therewith. This establishes a magnetic loop: the magnetic field coming from one of the axial ends of the magnetic element is channeled by the link member towards the opposite-polarity end of the magnetic element.

BRIEF DESCRIPTION OF THE DRAWINGS

Other characteristics and advantages of the invention appear on reading the following description of particular, non-limiting embodiments of the invention given with reference to the accompanying figures, in which.

MORE DETAILED DESCRIPTION

Figure 1:
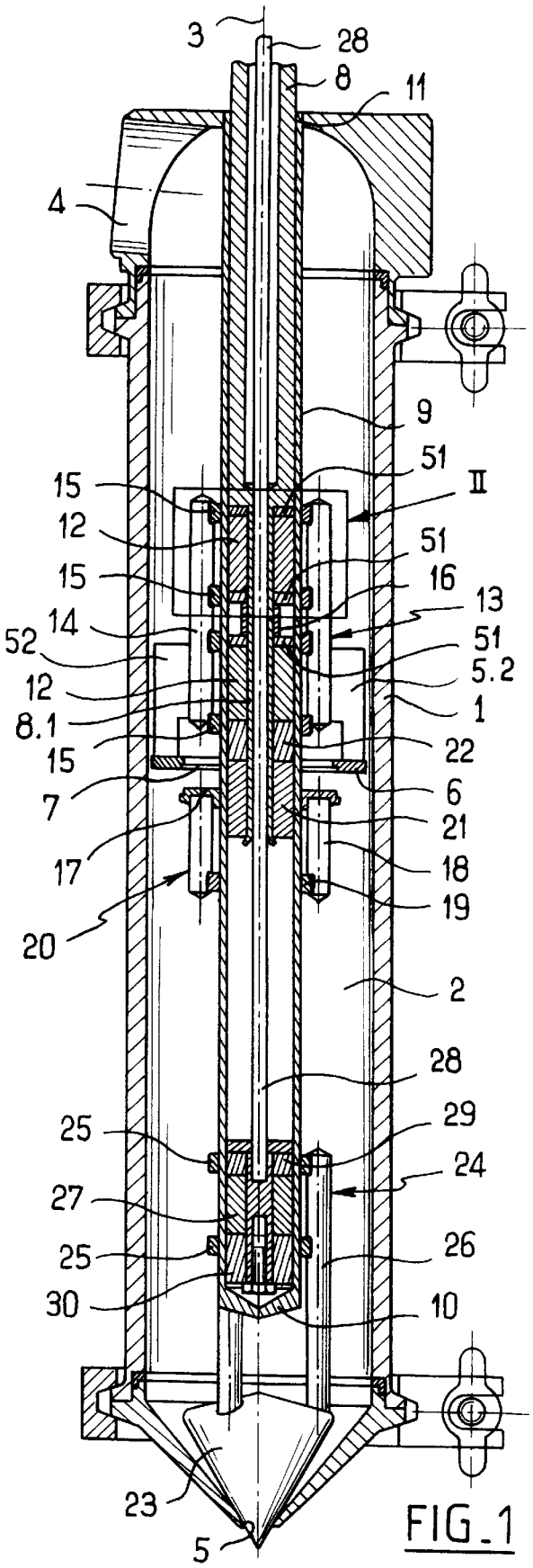
FIG. 1 is a section view on an axial plane through a magnetically controlled metering pump of the invention.
Figure 2:
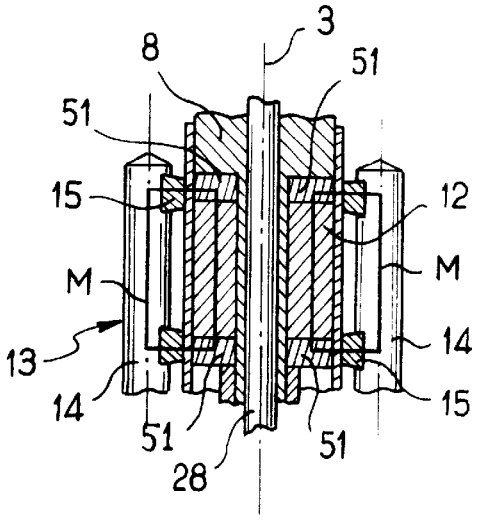
FIG. 2 is a view on a larger scale of box II in FIG. 1.

In FIGS. 1 and 2, there can be seen a metering pump of the invention. The pump comprises a pump body 1 defining a cylindrical pump chamber 2 having a vertical longitudinal axis 3 and presenting an admission orifice 4 and a delivery orifice 5, which orifices are situated respectively at the top end and at the bottom end of the chamber 2. A separator piston 6, in this case in the form of a disk, is mounted inside the chamber 2 to slide longitudinally with reciprocating motion between the admission orifice 4 and the delivery orifice 5. The piston 6 has a hollow center and is thus in the form of a flat annulus whose inside edge co-operates with the outside face of a sleeve 9 to define a central pumping orifice 7.

Displacement of the piston 6 is controlled by a first drive rod 8 of non-magnetic material which is mounted inside the sleeve 9 which is also made of non-magnetic material and which is secured to the pump body 1, extending coaxially inside it. The sleeve 9 possesses a closed end 10 situated inside the pump chamber 2 close to the delivery orifice 5 and an open opposite end 11 fixed to the pump body 1 and opening out to the outside of the pump body.

The first drive rod 8 is connected outside the pump body 1 to an actuator device (not shown) and it penetrates into the sleeve 9 through its open end 11. Inside the sleeve 9, the first drive rod 8 is fitted with two first annular permanent magnets 12 that generate a magnetic field in a direction parallel to the axis 3, with each of the magnets extending between two rings of magnetic material 51. The two magnets 12 and the associated rings 51 are engaged on a small diameter end portion 8.1 of the first drive rod 8 and they are spaced apart by a spacer 16 of non-magnetic material.

These magnets 12 co-operate with a first magnetic cage 13 mounted to slide axially outside the sleeve 9 and coupled to the piston 6 by means of thin, longitudinally-extending link tabs 52.

The magnetic cage 13 is made of a material of high magnetic permeability. In this case, it comprises a plurality of bars 14 extending parallel to the axis 3 around the sleeve 9 and connected to four rings 15 surrounding the sleeve. The four rings 15 are mounted in pairs, each of which pairs is associated with one of the two magnets 12. As can be seen more clearly in FIG. 2, the rings 15 in each pair are spaced apart and disposed facing the two axial ends of the corresponding magnet 12 and the associated rings of magnetic material 51. Since the axial ends of each magnet 12 are of opposite polarities, a looped magnetic field is established passing inside the magnet 12, through the rings 51, the rings 15, and the link rods 14, as symbolized by bold line M. Good magnetic coupling is thus obtained, thereby enabling the magnets 12 to be miniaturized.

The piston 6 is thus caused to move inside the pump chamber 2 by means of the first drive rod 8. It will be understood that the magnetic loop M acting between each magnet 12 and the magnetic cage 13 serves to couple the cage 13, and thus the piston 6, to the rod 8 in the direction of the longitudinal axis 3. The piston 6 is thus secured to the first drive rod 8 through the sleeve 9 and is thus driven with reciprocating motion by the rod 8. This disposition provides the advantage of completely isolating the first drive rod 8 from the flow inside the pump chamber 2, such that no sealing needs to be provided between the rod and the pump body 1.

A non-return valve 17 is mounted on the sleeve 9 to slide axially between an open position and a closed position for the pump orifice 7 of the piston 6. In this case, the valve 17 is in the form of a disk which is complementary in shape to the orifice 7. The valve 17 is connected to a ring 19 via link bars 18 extending parallel to the axis 3. The valve 17, the bars 18, and the ring 19 are made of material having high magnetic permeability, thereby forming a second magnetic cage 20 analogous to the cage 13 used for moving the piston 6. This magnetic cage 20 co-operates through the sleeve 9 with a second annular magnet 21 fixed on the portion 8.1 of the first drive rod 8. The magnet 21 is spaced apart from the second magnet 12 by a spacer 22 of magnetic material. The magnetic flux of the second magnet 12 is thus shared in the spacer 22 between a portion which forms a magnetic loop with the facing ring 15 associated with the piston 6, and another portion which reinforces the magnetic flux of the magnet 21 so as to urge the magnetic cage 20 constantly towards closing the pump orifice 7 by means of the valve.

A valve 23 is mounted on the sleeve 9 to slide along the axis 3 between an open position and a closed position for the delivery orifice 5. The valve 23 is secured to a third magnetic cage 24 analogous to the magnetic cages 13 and 20 described above. The cage 24 thus has two rings 25 of high magnetic permeability material spaced apart from each other and interconnected by link rods 26 parallel to the axis 3. The valve 23 is fixed to one end of the bars 26. The magnetic cage 24 co-operates via the sleeve 9 with a third annular magnet 27 mounted to slide in the sleeve 9 and coupled to a second drive rod 28 which passes through the first drive rod 8 and which can slide freely therein. Specifically, the magnet 27 is mounted between two clamping disks 29 and 30 of magnetic material secured to the rod 28.

The valve 23 can thus be opened or closed at will by acting on the second drive rod 28 independently of the first drive rod 8, the magnet 27, the clamping disks 29 and 30, and the magnetic cage 24 providing axial magnetic coupling between the valve 23 and the second drive rod 28.

In operation, the admission orifice 4 is preferably charged, i.e. the pump chamber 2 is fed with fluid under pressure, which pressure is determined so that the force generated on the non-return valve 17 is slightly smaller than the return force exerted by the magnet 21 on the cage 20 when the non-return valve is in its closed position. Whatever the position of the piston 6, the valve 17 is thus held in its closed position.

When the piston 6 is at bottom dead center, close to the delivery orifice 5, the valve 23 is in its closed position and the pump chamber is full of fluid both above and below the piston 6.

While the piston 6 is being pulled by the rod 8 towards the admission orifice 4, the pressure that results from the displacement of the piston adds to the pressure that results from feeding the fluid under pressure so that the non-return valve 17 is moved away from the pump orifice 7 against the return force exerted by the magnet 21 on the magnetic cage 20. In this context, it will be observed that the return force exerted by the magnet 21 decreases in magnitude as the distance to the magnetic cage 20 increases. The magnitude of the return force is therefore smaller when the valve 17 is in its open position than when it is in its closed position. When the piston 6 moves, the valve 17 therefore opens quickly to the fully open position, thus making it easier to move the piston 6. The fluid to be packaged thus passes through the piston 6 while remaining stationary without any fluid passing through the admission orifice.

When the piston 6 reaches its top dead center position, close to the admission orifice 4, the second drive rod 28 is operated to act via the magnetic coupling between the magnet 27 and the cage 24 to move the valve 23 into its position where it opens the delivery orifice 5. Simultaneously, the first drive rod 8 is actuated to push the piston 6 back towards the delivery orifice 5. The force exerted by the fluid on the non-return valve due to displacement of the piston 6 then adds to the magnetic return force of the magnet 21 and closes the non-return valve 17. Preferably, the piston 6 is displaced at a speed that is substantially equal to the speed at which the fluid flows out through the delivery orifice 5. The fluid is thus at substantially the same pressure above and below the piston 6 which accompanies the fluid that is situated inside the pump chamber 2 as it flows towards the delivery orifice. As a result, the piston 6 is not subject to the sealing requirements of an ordinary piston that exerts pumping pressure. It therefore need not have any piston rings and it can be mounted with clearance inside the chamber 2, as shown in FIG. 1.

At the end of its stroke, when the piston 6 reaches its bottom dead center point close to the delivery orifice 5, the second drive rod 28 is actuated to put the valve 23 into its position for closing the delivery orifice 5. The metering pump is ready for a new cycle.

When the pump is being cleaned, it suffices to deliver cleaning fluid at high pressure via the admission orifice of the pump while simultaneously opening the valve 23. The pressure of the cleaning fluid opens the non-return valve 17 and keeps it open throughout the cleaning process. The clearance around the piston 6 also enables cleaning fluid to flow around the piston so that the pump is cleaned in full without any need to disassemble it. It is also possible to perform cleaning by imparting reciprocating motion to the piston and/or by providing a pumping chamber with an enlarged portion into which the piston is moved during cleaning so as to increase the clearance between the edge of the piston and the inside wall of the pumping chamber, thereby making it easier for the cleaning fluid to flow around the piston.

Figure 3:
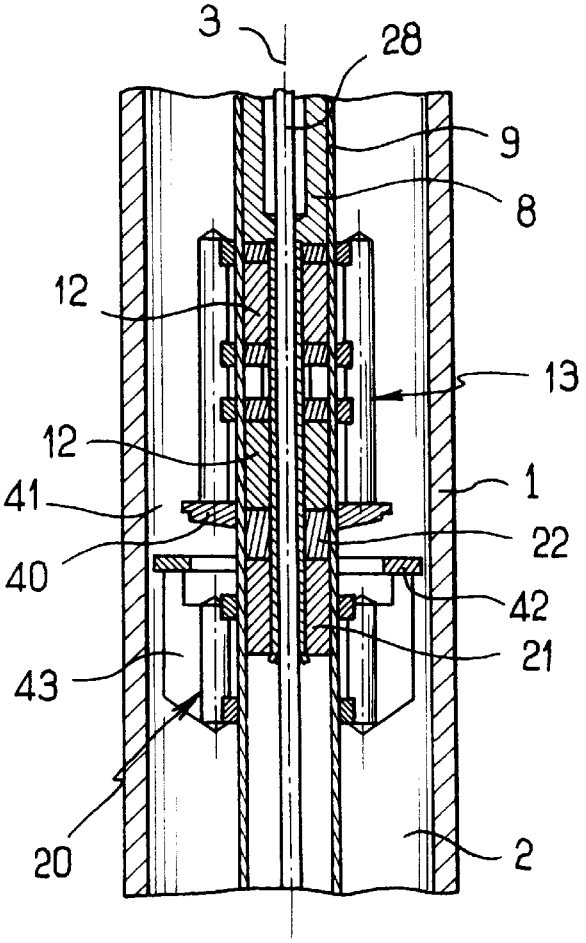
FIG. 3 is a fragmentary axial section showing a first variant embodiment of the piston and the valve.

FIG. 3 shows a first variant embodiment of the piston and the valve. The piston, which is referenced 40 in this case, is fixed directly to the bottom ends of the bars 14 of the magnetic cage 13. The piston 40 does not have a central pump orifice, but is centrally mounted with a small amount of functional clearance on the sleeve 9 and has an outside diameter that is significantly smaller than the inside diameter of the pump body 1, such that its peripheral edge co-operates with the inside face of the pump body 1 to define a peripheral pumping orifice 41.

This pumping orifice 41 is closed by an annular valve 42 which is connected to the magnetic cage 20 via longitudinal link tabs 43. The valve 42 is shaped to match the orifice 41 and therefore surrounds the piston 40 when the valve is closed. As before, for the piston 6, a small amount of clearance can be provided between the peripheral edge of the valve 42 and the inside face of the pump body 1.

This variant embodiment provides the advantage of increasing the flow section through the pump orifice and of improving flow by ensuring that the fluid changes direction only once on passing through the piston.

Figure 4:
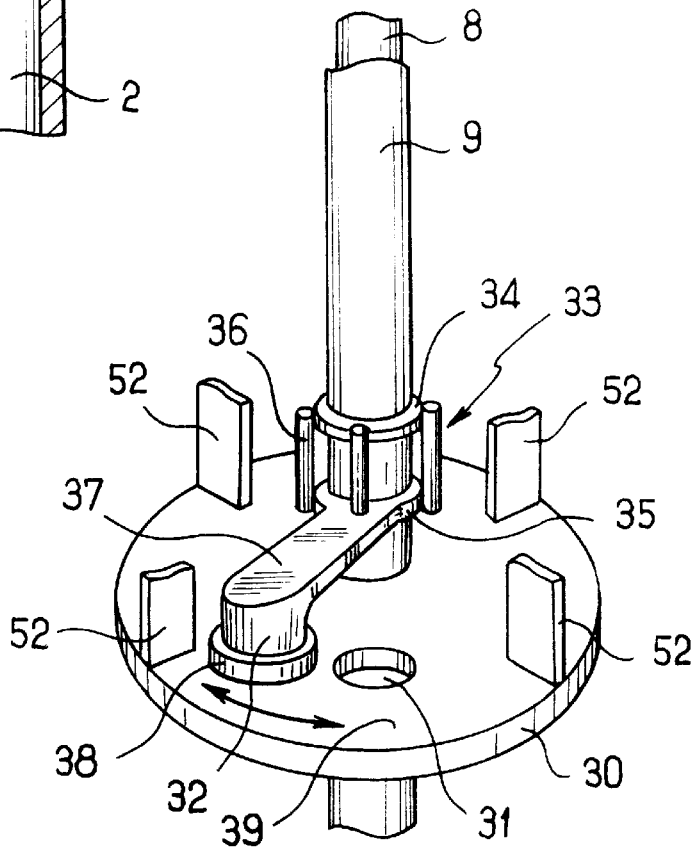
FIG. 4 is a diagrammatic perspective view showing a second variant embodiment of the piston and the valve.

FIG. 4 shows a second variant embodiment of the piston and of the valve. In this case, the piston is given reference 30, and it has a pump orifice 31 that is offset relative to the sleeve 9. The pump orifice 31 is closed by a valve 32 which is mounted on the sleeve 9 by means of a magnetic cage 33 so as to be capable of pivoting about the sleeve.

The magnetic cage 33 is made of a material having high magnetic permeability, and like the above-described cage 21 it comprises two rings 34 and 35 interconnected by link bars 36 extending parallel to the sleeve 9. The ring 35 that is the closer to the piston 30 is extended by a bracket 37 whose free end forms the valve 32. The valve 32 has a base 38 with a working bottom face that slides over a plane top face 39 of the piston 30 when the magnetic cage 33 pivots about the sleeve 9. Thus, when the valve 32 and its magnetic cage 33 pivot towards the position for closing the pump orifice 31, the base 38 of the valve 32 covers the opening by performing lateral shear motion in such a manner as to expel or cut any solid particles that may be found at the edge of the pump orifice 31.

The magnetic cage 33 is moved in the same manner as before by magnetic coupling between the cage 33 and a magnetic element secured to the rod 8. However, in this case coupling is no longer axial only, but is also angular, i.e. pivoting of the magnetic cage 33 is coupled to pivoting of the first drive rod 8. The magnetic element associated with the rod 8 is therefore no longer constituted by an annular magnet, but is made up, for example, by a plurality of magnets extending radially inside the sleeve 9 to correspond with the link bars 36 of the magnetic cage 33.

The invention is not limited to the embodiments described above, but on the contrary covers any variant using equivalent means to reproduce the essential characteristics of the invention.

In particular, although the pump described is filled under pressure, so that the piston acts only as a separator and applies hardly any pumping pressure, it is also possible to provide a conventional pump in which the piston is fitted with piston rings so as to be capable of delivering pumping work, in association with a non-return valve on the feed duct. The magnetic control system of the invention would then remain unchanged.

Although the return magnet 21 for the non-return valve 17 is shown in one embodiment as being carried by the same control rod as the magnets 12 used for controlling the position of the piston 6, it is also possible to implement the invention with the magnet 21 mounted on a rod that is separately controlled and whose movements are synchronized with those of the piston for opening and closing the pump orifice.

What is claimed is:

1. A metering pump comprising a pump body (1) defining a cylindrical pump chamber (2) having a longitudinal axis (3) and presenting an admission orifice (4) and a delivery orifice (5) situated at opposite ends thereof, a sleeve (9) of non-magnetic material mounted stationary inside the pump body (1) parallel to the longitudinal axis (3) of the pup chamber (2) and possessing a closed end (10) situated inside the pump body (1), and an open end (11) opening to the outside of the pump body (1), a drive rod (8) extending in the non-magnetic sleeve and fitted with a magnetic element (12) acting through the sleeve (9) to co-operate with a magnetic cage (13) surrounding the non-magnetic sleeve (9), said cage being coupled to a piston (6; 30; 40) extending transversally between the non-magnetic sleeve and the pump body for a sliding reciprocating motion between the admission orifice (4) and the delivery orifice and having a pump orifice (7; 31; 41) passing therethrough, and a valve (17; 32; 42) mounted to move relative to the piston (6; 30; 40) between a position in which it opens the pump orifice (7; 31; 41) and a position in which it closes it.

2. A pump according to claim 1, wherein the drive rod (8) is fitted with a second magnetic element (21) co-operating through the sleeve (9) with a second magnetic cage (20; 33) surrounding the sleeve (9) and secured to the valve (17; 32).

3. A pump according to claim 2, wherein the valve (17) and the second magnetic cage (20) are mounted to slide on the sleeve (9) and in that the second magnetic element (21) is disposed to urge the valve constantly towards its closed position.

4. A pump according to claim 1, wherein in register with the delivery orifice (5) it has a closure valve (23) coupled to a magnetic cage (24) surrounding the sleeve (9) and co-operating, through said sleeve, with a magnetic element (27) housed inside the sleeve (9) and associated with a second drive rod (28) extending in part inside the sleeve (9).

5. A pump according to claim 4, wherein the piston (6) is mounted with clearance inside the pump chamber (2).

6. A pump according to claim 2, wherein the valve (32) and the second magnetic cage (33) are mounted to pivot relative to the sleeve (9).

7. A pump according to claim 1, wherein the magnetic cage (13; 20; 24; 33) comprises at least two rings (15; 17; 19) surrounding the sleeve (9) and interconnected by a link member (14; 18; 36) extending parallel to the sleeve (9), the magnetic element (12; 21) generating a magnetic field parallel to the axial direction of the sleeve (9) and possessing two ends having the rings (15; 17; 19) of the magnetic cage (13; 20; 33) placed in register therewith.

* * * * *